US007259614B1

(12) United States Patent
Baker et al.

(10) Patent No.: US 7,259,614 B1
(45) Date of Patent: Aug. 21, 2007

(54) VOLTAGE SENSING CIRCUIT

(75) Inventors: William G. Baker, North Parramatta (AU); Timothy Gillespie, Beverly Hills (AU)

(73) Assignee: Integrated Device Technology, Inc., San Jose, CA (US)

( * ) Notice: Subject to any disclaimer, the term of this patent is extended or adjusted under 35 U.S.C. 154(b) by 41 days.

(21) Appl. No.: 11/187,680

(22) Filed: Jul. 22, 2005

Related U.S. Application Data

(60) Provisional application No. 60/658,855, filed on Mar. 3, 2005.

(51) Int. Cl.
*G05F 1/10* (2006.01)

(52) U.S. Cl. ..... 327/538; 327/539; 327/540; 327/541; 327/542; 327/543; 323/311; 323/312; 323/313; 323/314; 323/315; 323/316; 323/317

(58) Field of Classification Search ..... 327/538–543
See application file for complete search history.

(56) References Cited

U.S. PATENT DOCUMENTS 5,357,149 A * 10/1994 Kimura ..... 327/512
5,619,164 A * 4/1997 Tomishima ..... 327/541
5,640,122 A * 6/1997 McClure ..... 327/530
5,686,825 A * 11/1997 Suh et al. ..... 323/316
6,794,928 B2 9/2004 Lei ..... 327/538
6,794,982 B2 9/2004 Inoue et al. ..... 338/47
7,095,272 B2 * 8/2006 Morishita ..... 327/541
2005/0200385 A1 * 9/2005 Parker et al. ..... 327/53

* cited by examiner

*Primary Examiner*—Tuan T. Lam
*Assistant Examiner*—Hiep Nguyen
(74) *Attorney, Agent, or Firm*—Kenneth Glass; Glass & Associates

(57) ABSTRACT

An auto voltage sense circuit uses voltage controlled current sources to generate a desired reference voltage level that closely tracks the variations and changes of a first voltage level and a second voltage level. The auto voltage sensing circuit includes a first voltage controlled current source operable to receive the first voltage level to generate a reference current that is proportional to the first voltage level. The auto voltage sensing circuit also includes a second voltage controlled current source operable to receive the second voltage level and the reference voltage to generate an output current that is proportional to the difference between the second voltage level and the reference voltage. The reference voltage causes the output current to be approximately equal to the reference current so as to generate a reference voltage that is proportional to the difference between the second voltage level and the first voltage level.

24 Claims, 9 Drawing Sheets

VOLTAGE SENSING CIRCUIT

CROSS REFERENCE TO RELATED APPLICATIONS

This application claims priority to U.S. provisional application Ser. No. 60/658,855 filed Mar. 3, 2005.

FIELD OF THE INVENTION

The present invention relates generally to the field of integrated circuits. More specifically, the present invention relates to voltage generator circuits used in Input/Output (I/O) unit of integrated circuits.

BACKGROUND ART

Integrated Circuits (IC) commonly include multiple semiconductor systems that operate at different voltage supply levels. These semiconductor systems can be laid out on a single semiconductor chip or on different semiconductor chips. A typical semiconductor system has input buffer units, logic core, and output buffers. The logic core in one semiconductor system operates at a different supply voltage level than that in another semiconductor system. To achieve interoperability between semiconductor systems, a high speed Metal Oxide Semiconductor Field Effect Transistor (MOSFET) output driver is used to shift an input signal at one supply voltage level to an output signal at another supply voltage level. In addition, high voltage output buffers are used at the output stage to insure high quality output signals.

Due to the requirements of high speed, low power consumption, high quality signals, and low fabrication costs, semiconductor systems utilize thin gate oxide semiconductor devices. However, thin gate oxide semiconductor components have low breakdown voltage. To protect these components, a reference voltage is introduced to high speed MOSFET output drivers and high voltage cascode output buffers to prevent the gate voltage and drain source voltage from exceeding the breakdown voltage. When an IC device consists of many semiconductor systems operating at different voltage supply levels, it needs different reference voltages to effectively protect the gate oxide of its semiconductor systems.

Some prior art voltage generators generate reference voltages based on either low voltage supply level (LV) or a fraction thereof, on one of more MOSFET threshold voltages above electrical ground, or on high voltage supply level (HV) or a fraction thereof. These prior art generators generate a reference voltage that is optimal for only one high voltage supply level. When systems have the same voltage supply levels (e.g., when HV=LV), these prior art voltage generators provide a reference voltage that is too high. Other prior art voltage generators generate the reference voltage based on one or more MOSFET threshold voltages below high voltage level. These prior art generators are difficult to compensate for temperature and process variations.

Thus, there is a need for a simple voltage generator for high voltage cascode output buffers that can automatically sense both high voltage supply level (HV) and low voltage supply level (LV) in IC devices. In addition, there is a need for a voltage generator that can generate an accurate and stable reference voltage.

SUMMARY OF THE INVENTION

The present invention provides an auto voltage sense circuit using voltage controlled current sources to generate a desired reference voltage level that closely tracks the changes of a first voltage level and a second voltage level. The auto voltage sensing circuit of the present invention includes a first voltage controlled current source operable to receive the first voltage level to generate a reference current proportional to the first voltage level. The auto voltage sensing circuit also includes a second voltage controlled current source operable to receive the second voltage level and the reference voltage to generate an output current proportional to the difference between the second voltage level and the reference voltage. The reference voltage causes the output current to be approximately equal to the reference current so as to generate a reference voltage that is proportional to the difference between the second voltage level and the first voltage level.

A method for generating a reference voltage that automatically senses a first voltage level and a second voltage level is disclosed in which a reference current proportional to the first voltage level is generated using a first voltage controlled current source, an output current proportional to the difference between the second voltage level and the reference voltage is generated using a second voltage controlled current source, and adjusting the reference voltage so that the reference current is approximately equal to the output current, and thus reference voltage being proportional to the difference between second voltage level and first voltage level.

These and other advantages of the present invention will no doubt become obvious to those of ordinary skill in the art after having read the following detailed description of the preferred embodiments, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
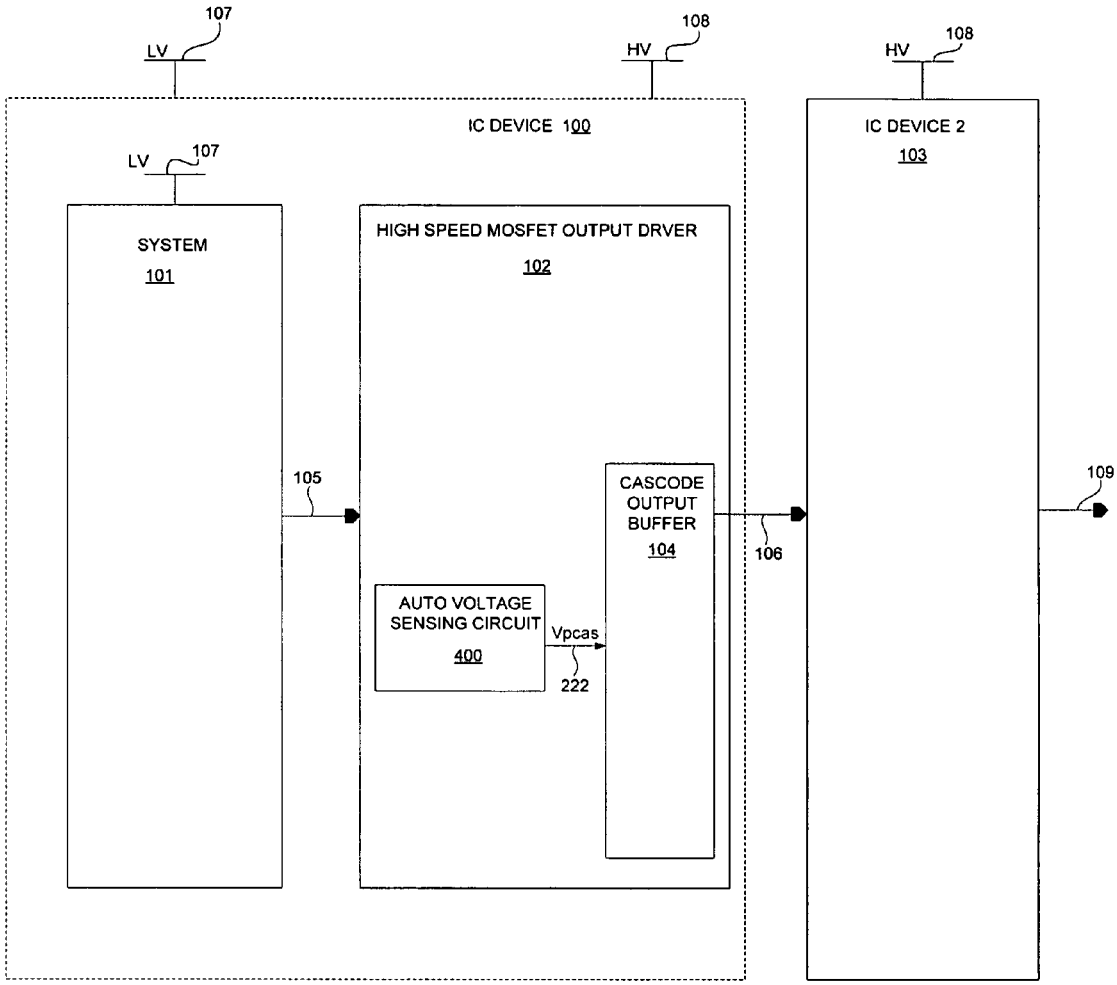
FIG. 1 illustrates a block diagram of an Integrated Circuit (IC) system involving a first IC device in communication with a second IC device that uses an auto voltage sensing circuit in a high speed MOSFET output to shift an input signal received from a first IC device operating at a first voltage level (LV) to an output at a second voltage level (HV) to drive a second IC device in accordance with an embodiment with the present invention (HV≠LV).

Referring to FIG. 1, a block diagram of an Integrated Circuit (IC) device 100 is shown in which an auto voltage sensing circuit 400 is used for protecting thin gate oxide Metal Oxide Semiconductor (MOS) components of systems 101-103. Auto voltage sensing circuit 400 is operable to generate a reference voltage ($V_{pcas}$) 222 which is the difference between a first voltage level (LV) and a second voltage level (HV) ($V_{pcas}$=HV−LV). As such, auto voltage sensing circuit 400 in accordance to the present invention is capable of automatically sensing the first voltage level (LV) and the second voltage level (HV).

Continuing with the embodiment shown in FIG. 1, IC device 100 includes a first system 101 operating at a first voltage level (LV) 107 and a second system 103 operating at a second voltage level (HV) 108. Because the first voltage level (LV) 107 is different from the second voltage level (HV) 108 (e.g., LV≠HV) in IC device 100 of FIG. 1, a high speed MOSFET output driver 102 is used to shift an input signal 105 received from first system 101 at first voltage level (LV) 107 to an output signal 106 at second voltage level (HV) 108. High speed MOSFET output driver 102 of IC device 100 uses thin gate oxide MOS transistors for high speed and low power consumption. In this embodiment, semiconductor systems 101 and 103 also include thin gate oxide MOS transistors. The term "thin gate oxide" as used in the present invention includes devices having a gate oxide thickness of 50 angstroms or less. The term "single thin gate oxide process" includes those semiconductor fabrication processes that form Metal Oxide Semiconductor Field Effect Transistor (MOSFET) devices having a gate oxide thickness that is less than 50 angstroms or less.

Continuing with FIG. 1, high voltage cascode output buffer 104 receives reference voltage ($V_{pcas}$) 222 from auto voltage sensing circuit 400 to protect thin oxide MOS components of IC device 100. Reference voltage ($V_{pcas}$) 222 limits the gate voltage and drain source voltage seen by thin gate oxide components. Thus reference voltage ($V_{pcas}$) 222 prevents gate voltage and drain source voltage from exceeding the breakdown voltage. Auto voltage sensing circuit 400 used in IC device 100 is capable of automatically sense first voltage level (LV) 107 and second voltage level (LV) 108. In one embodiment of the present invention, IC device 100 consists of many systems similar to first system 101 and second system 103 that operate at different voltage supply levels. Different values of reference voltages ($V_{pcas}$) 222 are needed to protect these systems. In one embodiment, first system 101 and second system 103 include programmable first voltage level (LV) 107 and second voltage level (HV) 108. Auto voltage sensing circuit 400 of the present invention automatically generates reference voltage ($V_{pcas}$) 222 whenever first voltage level (LV) 107 and second voltage level (HV) 108 are programmed to different values so as to effectively protect the gate oxide of semiconductor systems 101 and 103.

First system 101 and second system 103, each includes high voltage cascode output buffer 104 and auto voltage sensing circuit 400. High voltage cascode output buffer 104 is usually located at the output stage to insure interoperability and compatibility between first semiconductor system 101 and second system 103. High voltage cascode output buffer 104 reduces the Miller effect of the parasitic capacitive loading of the drain gate of the previous stage. In addition, high voltage cascode output buffer 104 has low input impedance and high output impedance, ideally for generating high quality output signals at an output terminal 109. Auto voltage sensing circuit 400 provides reference voltage ($V_{pcas}$) 222 to protect the thin gate oxide of high voltage cascode output buffer 104.

Figure 1A:
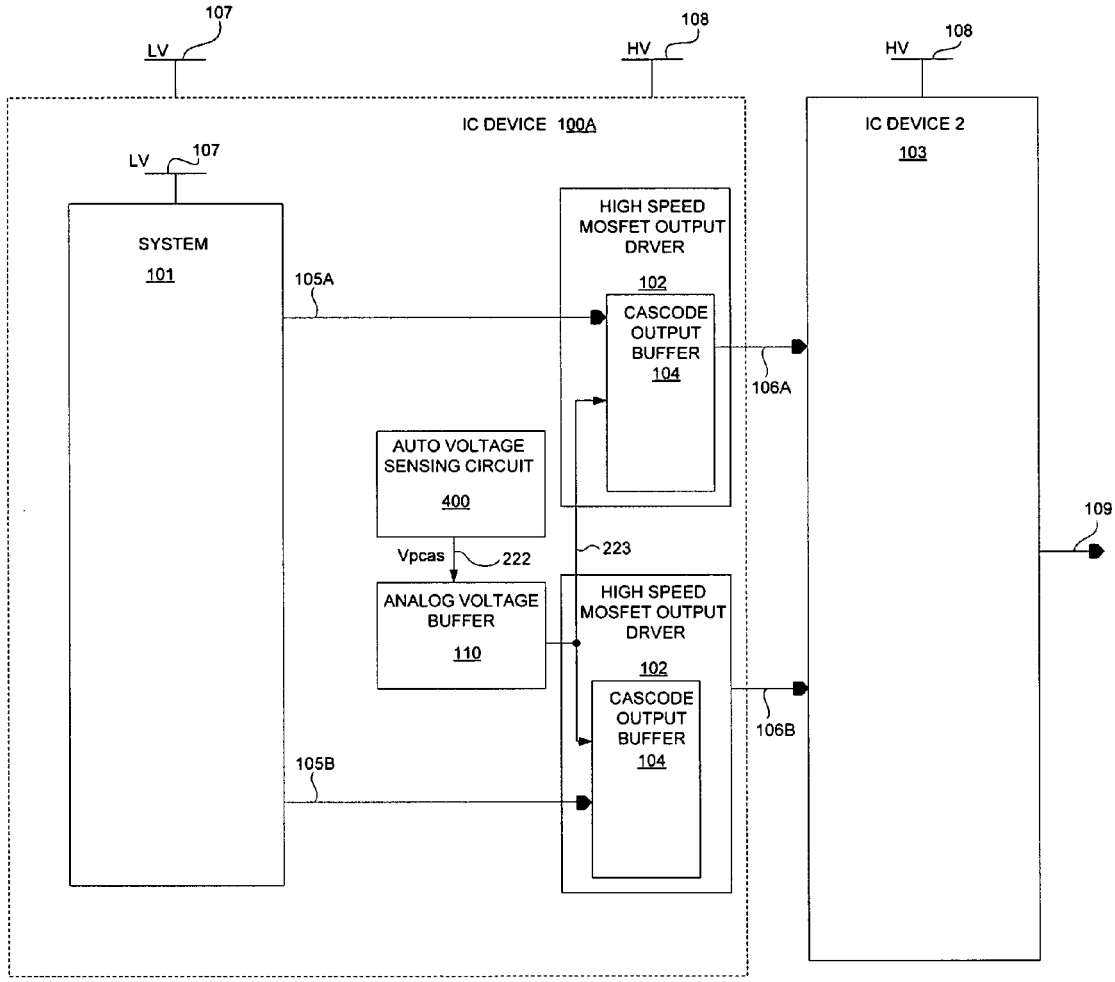
FIG. 1A illustrates one embodiment of IC system of FIG. 1 that includes an analog voltage buffer to drive one or more high speed MOSFET output drivers.

FIG. 1A shows an embodiment in which Integrated Circuit (IC) device 100A that drives more than one output signal to external IC device 103 operating at the same second voltage level (HV) 108. To achieve such arrangement, IC device 100A uses an analog voltage buffer to drive one or more high speed MOSFET output buffers 104. High speed MOSFET output buffers 104 provide output signals 106A and 106B at second voltage level (HV) 108 to external IC device 103.

IC device 100A includes system 101, auto voltage sensing circuit 400, and analog voltage buffer 110, and more than one high speed MOSFET output drivers 102. Each high speed MOSFET output driver 102 includes a cascode output buffer 104. In one embodiment of the present invention, as shown in FIG. 1A, IC device 100A includes two high speed MOSFET output drivers 104 driven by output signals 105A and 105B of system 101. High speed MOSFET output buffers 104 receive and shift output signals 105A and 105B at first voltage level (LV) 107 to output signals 106A and 106B at second voltage level (HV) 108, respectively. Analog voltage buffer 110 receives reference voltage ($V_{pcas}$) 222 from auto voltage sensing circuit 400 to drive multiple high speed MOSFET output drivers 104. Analog voltage buffer 110 avoids the use of more than one auto voltage sensing circuit 400 in IC device 100A. Multiple auto voltage sensing circuits 400 in IC device 100A add complexity in the IC and increase the chance of non-uniformity in reference voltages ($V_{pcas}$) 222. In addition, analog voltage buffer 110 lowers the impedance of reference voltage ($V_{pcas}$) 222 to reduce cross-talk between output signals 106A and 106B.

Figure 2:
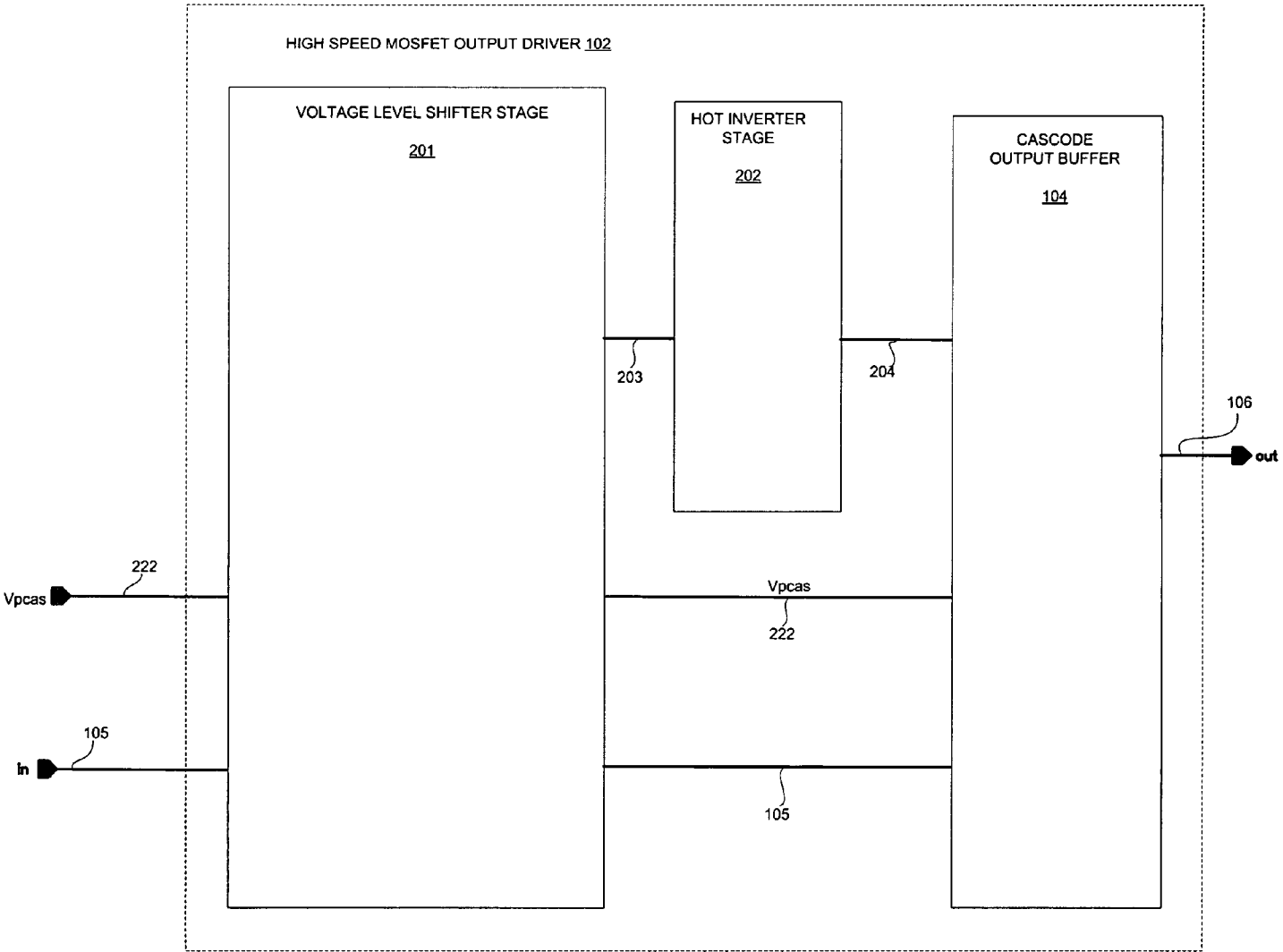
FIG. 2 illustrates a block diagram of a high speed MOSFET output driver that uses a reference voltage ($V_{pcas}$) from an auto voltage sensing circuit in accordance with an embodiment of the present invention.

FIG. 2 shows an embodiment in which Metal Oxide Semiconductor Field Effect Transistor (MOSFET) output driver 102 includes a voltage level shifter stage 201, a hot inverter stage 202, and high voltage cascode output buffer 104 that are electrically coupled to auto voltage sensing circuit 400. High speed MOSFET output driver 102 receives input signal 105 from first system 101 operating at first voltage level (LV) 107 and transitions input signal 105 to output signal 106 at second voltage level (HV) 108. Voltage level shifter stage 201 receives input signal 105 at first voltage level (LV) 107 and shifts input signal 105 to a logic value 203 at second voltage level (HV) 108. Voltage level shifter stage 201 is operably coupled to high voltage cascode output buffer 104 to cause high voltage cascode output buffer 104 to generate the desired level shifted voltage signal 106 at second voltage level (HV) 108. Hot inverter stage 202 receives output signal 203 from voltage level shifter stage 201 and shifts it to logic value 204 that is received by high voltage cascode output buffer 104. High voltage cascode output buffer 104 receives logic level 204 from hot inverter stage 202 and generates output signal 106 at second voltage level (HV) 108. Output signal 106 from high speed MOSFET output driver 102 drives second system 103 in FIG. 1. Because high speed MOSFET output driver 102 uses thin gate oxide components to drive a voltage greater than the gate oxide voltage limit, it uses auto voltage sensing circuit 400 to provide voltage preference ($V_{pcas}$) 222 which limits the gate voltage seen by the gate oxide of the thin gate oxide components.

In one embodiment of the present invention, high speed MOSFET output driver 102 is identical to the high speed MOSFET output driver in the U.S. patent application titled, "High Speed MOSFET Output Driver", by Timothy Gillespie and William G. Baker, which is filed on the same date herewith and which is hereby incorporated by reference in its entirety.

Figure 3:
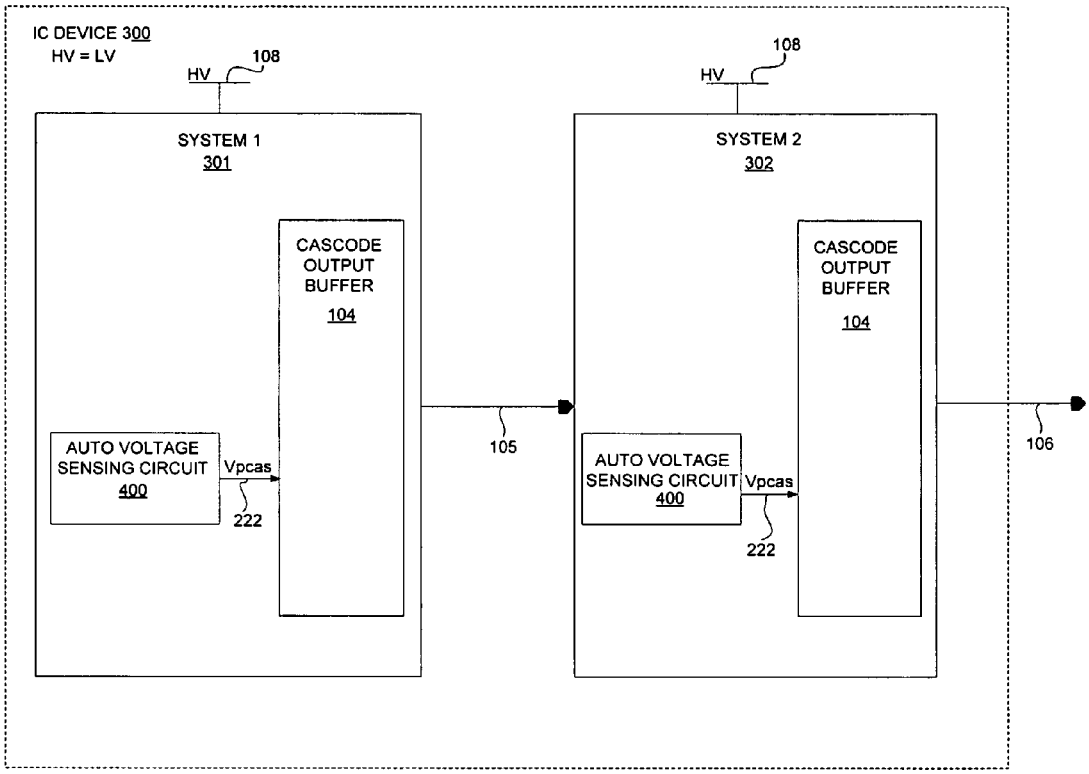
FIG. 3 illustrates a block diagram of an IC device that uses a reference voltage ($V_{pcas}$) from an auto voltage sensing circuit in a first system and a second system, where the operating voltage levels of both systems are the same (LV=HV) in accordance with an embodiment of the present invention.

Now referring to FIG. 3, IC device 300 is shown that includes a first system 301 and a second system 302 which are operating at the same voltage level (HV=LV). Therefore, IC device 300 does not require high speed MOSFET output driver 102 to shift an input signal 105 from first voltage level (LV) 107 to output signal 106 at second voltage level (HV) 108. IC device 300 has high voltage cascode output buffer 104 coupled to auto voltage sensing circuit 400.

Cascode output buffer 104 is used in the output stage of first system 301 and second system 302 because auto voltage sensing circuit 400 of the present invention can automatically sense first voltage level (LV) 107 and second voltage level (HV) 108 to protect thin gate oxide components of high voltage cascode output buffer 104 and systems 301-302. More particularly, auto voltage sense circuit 400 generates reference voltage ($V_{pcas}$) 222 that is used in each system to ensure the voltage swing of high voltage cascode output buffer 104 does not surpass gate oxide voltage limit of its components. In IC device 300 when first system 301 and second system 302 operate at the same voltage level (e.g., LV=HV), first system 301 is not required to drive a voltage greater than the gate oxide voltage limit of its logic core, and thus no gate oxide protection is necessary. For this reason, reference voltage ($V_{pcas}$) 222 is zero volts. Auto voltage sensing circuit 400 automatically senses first voltage level (LV) 107 and second voltage level (HV) 108, and produces 0 volt $V_{pcas}$ in IC device 300.

Figure 4:
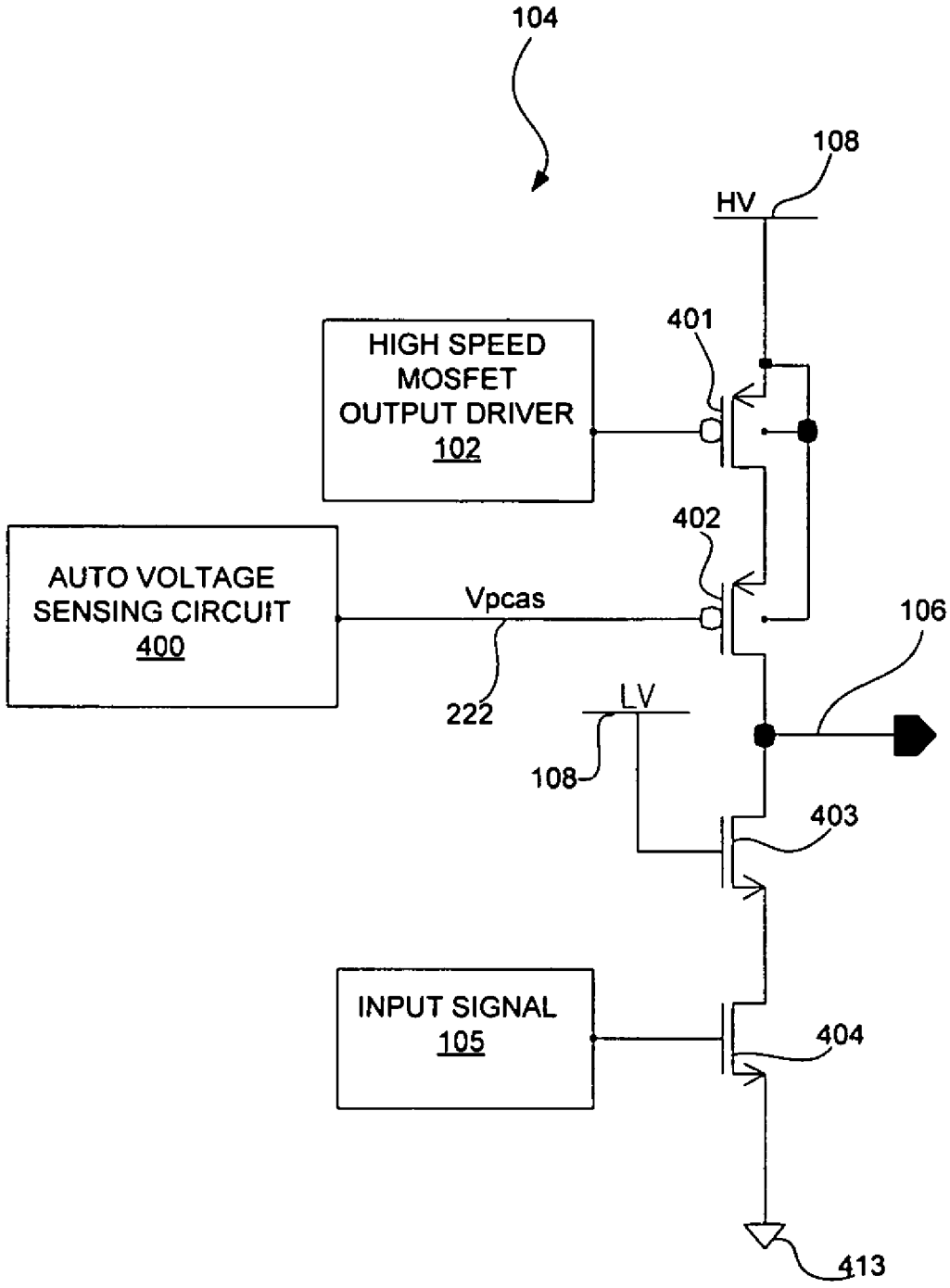
FIG. 4 illustrates schematic diagram of a high voltage cascode output buffer that uses a reference voltage ($V_{pcas}$) from an auto voltage sensing circuit to protect thin gate oxide components in accordance with an embodiment of the present invention.

Now referring to FIG. 4, a schematic diagram of high voltage cascode output buffer 104 used in IC devices 100 and 300 is illustrated. High voltage cascode output buffer 104 utilizes the cascading of the thin gate oxide devices 401-404 to prevent over voltage degradation to each of the respective thin gate devices. In the present embodiment, IC devices 100 and 300 are formed using single thin gate oxide process. As a result, IC devices 100 and 300 achieve increase speed, reduce power consumption, and fabrication costs as compared to devices formed using prior art dual-gate processes.

High voltage cascode output buffer 104 receives an output signal from high speed MOSFET output driver 102 to generate output voltage 106. More particularly, high voltage cascode output buffer 104 is configured as an inverter that includes two PMOS transistors 401 and 402 electrically connected in cascode with two NMOS transistors 403 and 404. PMOS transistor 402 and NMOS transistor 403 reduce the maximum field at the drain source of PMOS transistor 401, reducing the likelihood of damage to the gate oxide of PMOS transistor 401 that can result from hot carrier effects. High voltage cascode output buffer 104 receives output signal from output driver 102 and generates the desired level shifted voltage 106 at second voltage level (HV) 108. The gate of PMOS transistor 401 is electrically connected to output driver 102. The source of PMOS transistor 401 is electrically connected to second voltage level (HV) 108. The drain of PMOS transistor 401 is electrically connected to the source of PMOS transistor 402. The drain of PMOS transistor 402 is electrically connected to the drain of NMOS transistor 403 to form an output terminal 106 of high voltage cascode output buffer 104. Output terminal 106 then drives external output loads of second semiconductor system 302 in FIG. 3 or second semiconductor system 103 in FIG. 1. The gate of PMOS transistor 402 is electrically connected to reference voltage ($V_{pcas}$) 222. and to auto voltage sensing circuit 400. The gate of NMOS transistor 403 is electrically connected to first voltage level (LV) 107. The source of NMOS transistor 403 is electrically connected to the drain of NMOS transistor 404. The gate of NMOS transistor 404 is electrically connected to input signal 105. The source of NMOS transistor 404 is electrically connected to electrical ground 413.

Continuing with FIG. 4, high voltage cascode output buffer 104 functions as an inverter with cascode PMOS transistor 402 and cascode NMOS transistor 403 in the middle to protect drain source voltage, and gate oxide voltage of pull-up PMOS 401 and pull down NMOS 404. When output driver 102 produces a logic high, PMOS transistor 401 is off. If input signal 105 is a logic high, then NMOS transistor 404 and cascode NMOS transistor 403 is on, and they pull output signal 106 to electrical ground 413. Cascode PMOS transistor 402 pulls its source down to $V_{pcas}+V_{thp}$, where $V_{thp}$ is the threshold voltage of cascode PMOS transistor 402. Thus, cascode PMOS transistor 402 limits the maximum drain source voltage of PMOS transistor 401 to HV−($V_{pcas}+V_{thp}$). For example, if second voltage level (HV) 108 is 3.3 volts and reference voltage ($V_{pcas}$) 222 is 0.8 volts and the threshold voltage of cascode PMOS transistor 402 ($V_{thp}$) is 0.8 volts, then the drain source voltage of PMOS transistor 401 is 1.7 volts (3.3 volts−(0.8 volts+0.8 volts)) instead of full 3.3 volts. Thus, reference voltage ($V_{pcas}$) 222 is very important in protecting thin gate oxide semiconductor components in high voltage cascode output buffer 104.

Continuing with FIG. 4, when input signal 105 is a logic low, NMOS transistor 404 is off. If output driver 102 produces a logic low, then PMOS transistor 401 and cascode PMOS transistor 402 are on, and they pull output signal 106 to second voltage level (HV) 108. The gate source voltage of cascode PMOS transistor 402 is $HV-V_{pcas}$. Cascode NMOS transistor 403 pulls its source up to $LV-V_{thn}$, where $V_{thn}$ is the threshold voltage of cascode NMOS transistor 403. Thus the maximum drain source voltage of NMOS transistor 404 is limited to $LV-V_{thn}$.

Continuing with FIG. 4, lowering the reference voltage ($V_{pcas}$) 222 lowers the rise time of output signal 106 by increasing the drain current of cascode PMOS transistor 402. However, the lowest $V_{pcas}$ voltage is set by the maximum safe gate source voltage of cascode PMOS transistor 402. The first voltage level (LV) 107 is less than this maximum safe voltage. If the reference voltage $V_{pcas}$ is made equal to HV−LV, then the gate source voltage of cascode PMOS transistor 402 is $HV-V_{pcas}=HV-(HV-LV)=LV$, which is less than this maximum safe voltage.

Figure 5:
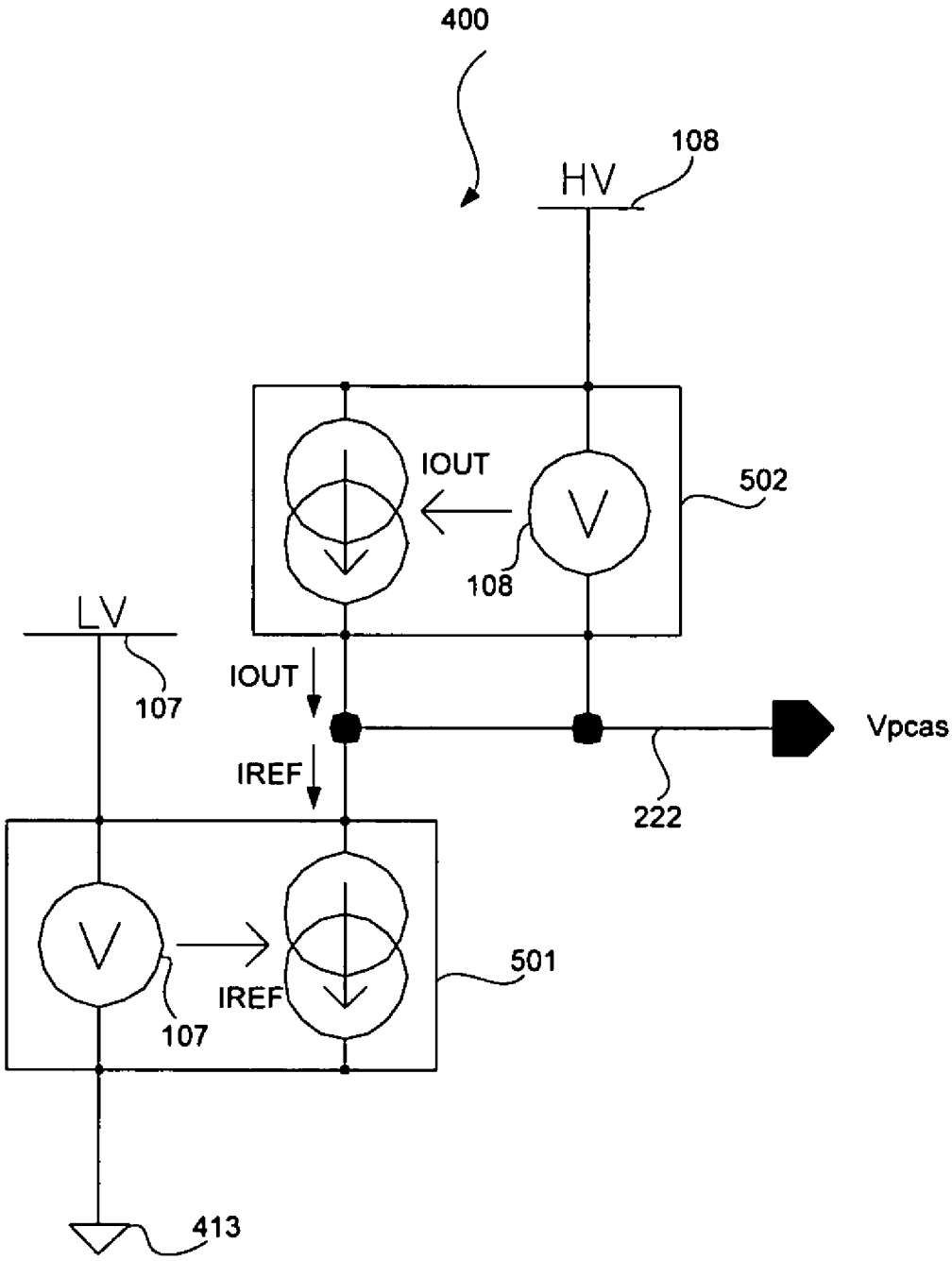
FIG. 5 illustrates the operational principles of an auto voltage sensing circuit that includes a first voltage controlled current source and a second voltage controlled current source electrically coupled to a first voltage level (LV) and a second voltage level (HV) for generating the reference voltage ($V_{pcas}$) that is proportional to the currents generated by both voltage controlled current sources in accordance with an embodiment of the present invention.

Now referring to FIG. 5, a block diagram of an embodiment of auto voltage sensing circuit 400 in which its operational principle is shown. Voltage generator 400 is configured to generate reference voltage ($V_{pcas}$) 222 using a first voltage controlled current source 501 and a second voltage controlled current source 502. First voltage controlled current source 501 is coupled to first voltage level (LV) 107 and coupled to electrical ground 413 to generate a reference current ($I_{ref}$). Second voltage controlled current source 502 is coupled to second voltage level (HV) 108 and coupled to reference voltage ($V_{pcas}$) 222 to generate an output current ($I_{out}$). Reference current ($I_{ref}$) depends on the voltage difference between first voltage level (LV) 107 and electrical ground 413. Output current ($I_{out}$) depends on the voltage difference between second voltage level (HV) 108 and reference voltage ($V_{pcas}$) 222. Reference voltage ($V_{pcas}$) 222 will change until reference current ($I_{ref}$) is equal to output current ($I_{out}$), which occurs when $$LV-0=HV-V_{pcas} \tag{1}$$

$$\text{Equivalently, } V_{pcas}=HV-LV \tag{2}$$

Accordingly, auto voltage sense circuit 400 of the present invention uses first voltage controlled current source 501 and second voltage controlled current source 502 to generate reference voltage ($V_{pcas}$) 222 that is equal to the difference between second voltage level (HV) 108 and first voltage level (LV) 107 as shown in Equation 2. As such, auto voltage sense circuit 400 automatically senses the changes in first voltage level (HV) 107 and second voltage level (LV) 108. For example, referring back to IC device 100 in FIG. 1, if first system 101 operates at 2.5 volts (e.g., LV=2.5 volts) and second system 103 operates at 3.3 volts (e.g., HV=3.3 volts). Reference voltage ($V_{pcas}$) 222 generated by auto voltage sensing circuit 400 in accordance to the present invention is $V_{pcas}$=HV−LV=3.3 volts−2.5 volts=0.8 volts. Now, if first voltage level (LV) 107 of first system 101 is changed to 1.5 volts. Reference voltage ($V_{pcas}$) 222 generated by auto voltage sensing circuit 400 in accordance to the present invention is $V_{pcas}$=HV−LV=3.3 volts−1.5 volts=1.8 volts. Referring back to IC device 300 of FIG. 3 when first system 301 and second system 302 have the same operating voltage level, which is HV=LV=2.5 volts. In this case, both systems 301 and 302 operate at low voltage level (e.g., 2.5 volts) and do not need gate oxide protection of reference voltage ($V_{pcas}$) 222. Thus, reference voltage ($V_{pcas}$) 222 is 0 volt, or $V_{pcas}$=HV−LV=0 volt.

Figure 6:
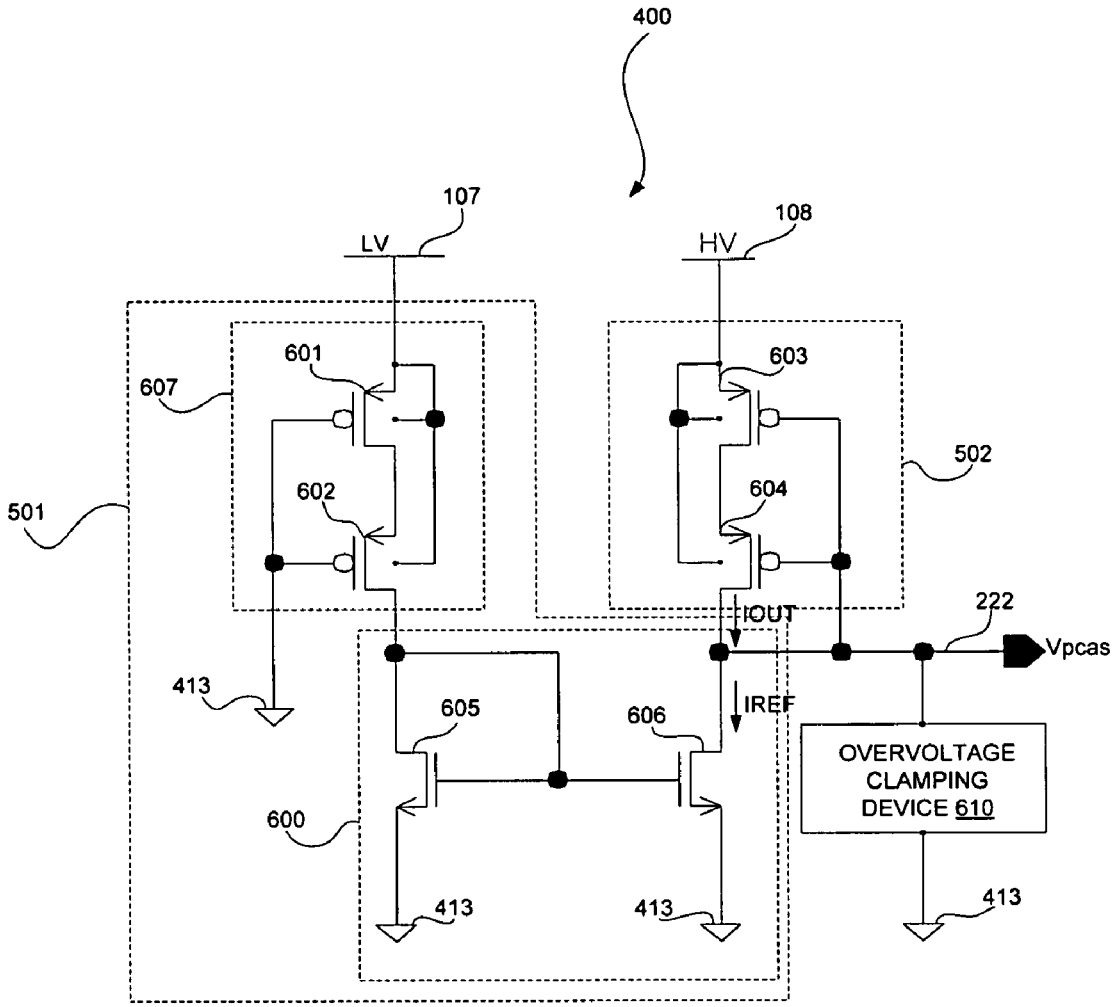
FIG. 6 illustrates a schematic diagram of an auto voltage sensing circuit that can be used by the IC device and high speed MOSFET output driver of FIGS. 1-3 in accordance with an embodiment of the present invention.

Referring to FIG. 6, an auto voltage sense circuit 400 is shown that includes first voltage controlled current source 501, a second voltage controlled current source 502, and an overvoltage clamping device 610. First voltage controlled current source 501 further includes a third voltage controlled current source 607 and current mirror 600. As discussed above in FIG. 5, second voltage controlled current source 502 adjusts reference voltage ($V_{pcas}$) 222 such that output current ($I_{out}$) is equal to the reference current ($I_{ref}$) of first voltage controlled current source 501, see Equation 1. Thus, reference voltage ($V_{pcas}$) 222 is generated and can be made equal to the difference between first voltage level (LV) 107 and second voltage level (LV) 108 (HV−LV), see Equation 2, provided that the device sizes are the same.

Third voltage controlled current source 607 includes a first PMOS transistor 601 and a second PMOS transistor 602. The source of first PMOS transistor 601 is electrically connected to first voltage level (LV) 107. The drain of first PMOS transistor 601 electrically connected to the source of second PMOS transistor 602. The gate of first PMOS transistor 601 is electrically connected to the gate of second PMOS transistor 602 and to electrical ground 413. The substrates of first PMOS transistor 601 and second PMOS transistor 602 are electrically connected together and to first voltage level (LV) 107. Second PMOS transistor 602 is cascading with first PMOS transistor 601 such that the output impedance of third voltage controlled current source 607 is increased.

First voltage controlled current source 501 also includes current mirror 600 which is electrically connected to both third voltage controlled current source 607 and second voltage controlled current source 502. Current mirror 600 includes a first NMOS transistor 605 and a second NMOS transistor 606. The gate of first NMOS transistor 605 is electrically connected to the gate of second NMOS transistor 606 and to the drain of said first NMOS transistor 605. First NMOS transistor 605 is diode connected to place it in the saturation region. The drain of first NMOS transistor 605 electrically connected to the drain of second PMOS transistor 602 of third voltage controlled current source 607. The drain of second NMOS 606 is electrically connected to second voltage controlled current source 502. The sources of first NMOS transistor 605 and second NMOS transistor 606 are electrically connected to electrical ground 413.

With reference to FIG. 6 again, second voltage controlled current source 502 is constructed the same way as third voltage controlled current source 607. Voltage controlled current source 502 has a first PMOS transistor 603 and a second PMOS transistor 604 electrically coupled together in cascode formation. The drain of first PMOS transistor 603 electrically connected to the source of second PMOS transistor 604. The gates of PMOS transistors 603 and 604 are electrically connected to reference voltage ($V_{pcas}$) 222. The substrates of first PMOS transistor 603 and second PMOS transistor 604 are electrically connected to the source of first PMOS transistor 603. The source of first PMOS transistor 603 is electrically connected to second voltage level (HV) 108.

Cascode PMOS transistor 602 holds the drain voltage of PMOS transistor 601 at a threshold voltage ($V_{thp}$) above ground. The drain source voltage of PMOS transistor 601 is thus $LV-V_{thp}$. The gate source voltage of PMOS transistor 601 is LV. The source bulk voltage of 601 is zero.

PMOS transistor 602 will be operating in the linear region, with a drain current given by:

$$I_d^{601}=\beta^{601}\times f(V_{gs}^{601},V_{ds}^{601},V_{sb}^{601}) \tag{3}$$

$$I_d^{601}=\beta^{601}\times f(LV,LV-V_{thp},0) \tag{4}$$

where $\beta^{601}$ is the ratio of the width and length of MOSFET 601, and $f$ is a function with three voltage arguments that returns a drain current. The exact form of function $f$ is unimportant to the operation of the circuit.

NMOS transistors 605 and 606 form a current mirror, such that the drain current of 606 is proportional to the drain current of 605. The drain current of 605 is equal to the drain current of 601.

$$I_d^{606} = \frac{\beta^{606}}{\beta^{605}} \times I_d^{601} \tag{5}$$

$$I_d^{606} = \frac{\beta^{606}}{\beta^{605}} \times \beta^{601} \times f(LV, LV - V_{thp}, 0) \tag{6}$$

Cascode PMOS transistor 604 holds the drain voltage of PMOS transistor 603 at a threshold voltage ($V_{thp}$) above $V_{pcas}$. The drain source voltage of PMOS transistor 603 is thus $(HV-V_{pcas})-V_{thp}$. The gate source voltage of PMOS transistor 603 is $HV-V_{pcas}$. The source bulk voltage of PMOS transistor 603 is zero. PMOS transistor 603 will be operating in the linear region with a drain current given by:

$$I_d^{603} = \beta^{603} \times f(V_{gs}^{603}, V_{ds}^{603}, V_{sb}^{603}) \tag{7}$$

$$I_d^{603} = \beta^{603} \times f(HV - Vpref, (HV - Vpref) - V_{thp}, 0) \tag{8}$$

where $f$ is the same function as in equations 11 and 12.

As $$I_d^{606} = I_d^{603}$$

we can combine equations 15 and 16

$$\frac{\beta^{606}}{\beta^{605}} \times \beta^{601} \times f(LV, LV - V_{thp}, 0) = \beta^{603} \times f(HV - Vpref, (HV - Vpref) - V_{thp}, 0) \tag{9}$$

$$\frac{\beta^{606}}{\beta^{605}} \times \frac{\beta^{601}}{\beta^{603}} = \frac{f(HV - Vpref, (HV - Vpref) - V_{thp}, 0)}{f(LV, LV - V_{thp}, 0)}$$

By a suitable choice of MOSFET widths and lengths we can make $$\frac{\beta^{606}}{\beta^{605}} \times \frac{\beta^{601}}{\beta^{603}} = 1$$

for example by making 603 the same size as 601, and 606 the same size as 605. Then a solution to equation 9 is $$HV-V_{pcas}=LV$$

or $$V_{pcas}=HV-LV \tag{10}$$

Referring to FIG. 6 again, in one embodiment of the present invention, voltage generator 400 includes an overvoltage clamping device 610 which limits the maximum voltage on reference voltage ($V_{pcas}$) 222. This will protect analog voltage buffer 110 or cascode output buffer 104 from high voltages in the event that the first voltage level (LV) 107 is at ground and the second voltage level (HV) 108 is at a high voltage, as might occur during power-up or power-down. In normal operation overvoltage clamping device 610 has no effect on reference voltage ($V_{pcas}$) 222. In one embodiment of the present invention, overvoltage clamping device 610 includes a plurality of NMOS transistors connected as diodes.

If the second voltage level (HV) 108 is at the same voltage as the first voltage level (LV) 107 then ideally reference voltage ($V_{pcas}$) 222 is at electrical ground 413. However, when reference voltage ($V_{pcas}$) 222 is near electrical ground 413 the current mirror 600 becomes inaccurate due to mismatched drain voltages of first NMOS transistor 605 and second NMOS transistor 606. This inaccuracy will result in reference voltage ($V_{pcas}$) 222 being too high. The circuit in FIG. 7 avoids this problem by keeping the drain voltages of first NMOS transistor 605 and second NMOS transistor 606 at similar voltages.

Figure 7:
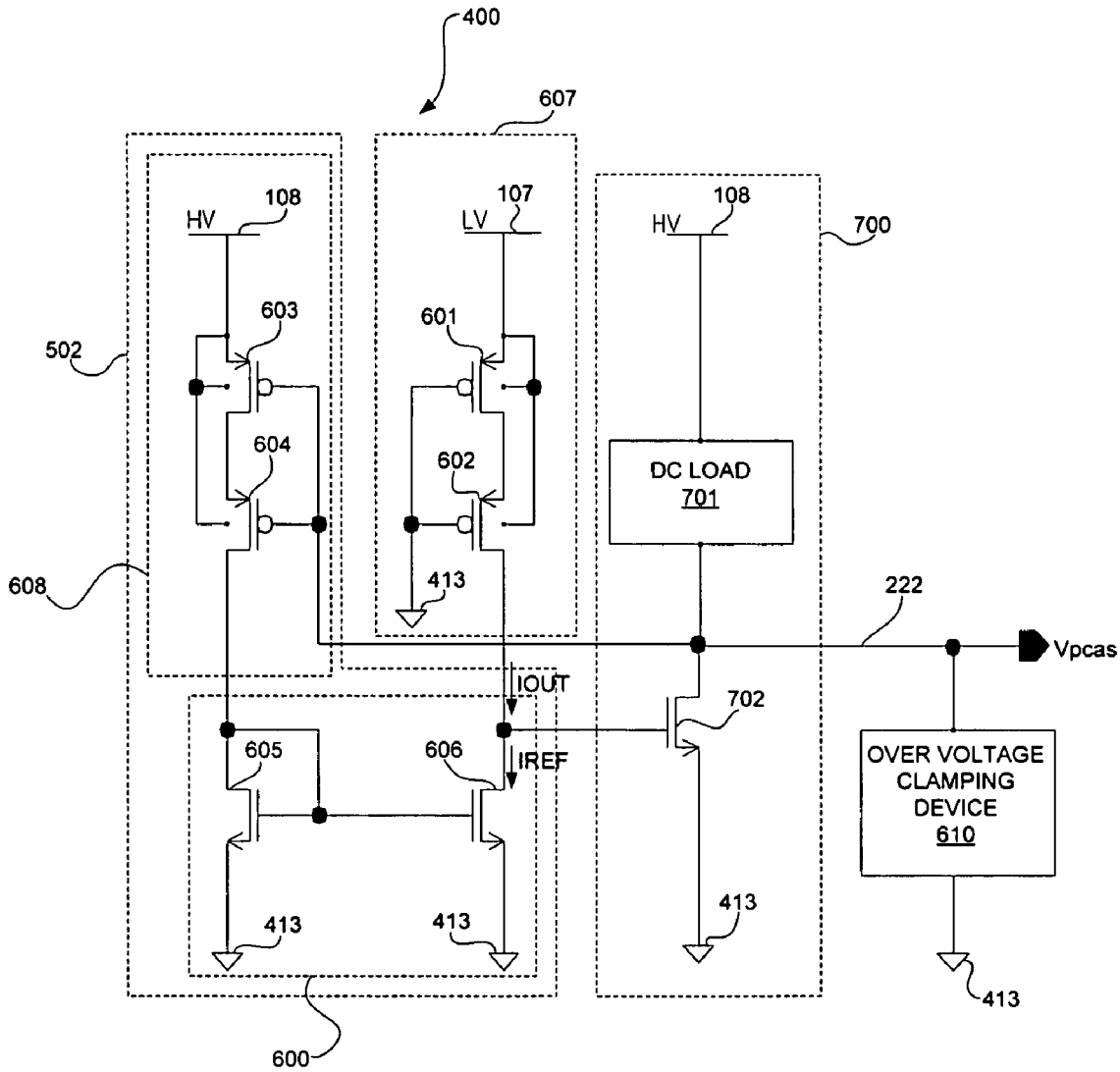
FIG. 7 is a schematic diagram that illustrates another embodiment of auto voltage sensing circuit that includes a control circuit to provide accuracy to the reference voltage ($V_{pcas}$) in accordance with the present invention.

Referring to FIG. 7, in one embodiment of the present invention, auto voltage sensing circuit 400 includes third voltage controlled current source 607, second voltage controlled source 502, overvoltage clamping device 610, and a control circuit 700 to maintain reference voltage ($V_{pcas}$) 222 at a constant level.

In the present embodiment, third voltage controlled current source 607 generates output current ($I_{out}$) that is proportional to first voltage level (LV) 107. Second voltage controlled current source 502 receives second voltage level (HV) 108 and reference voltage ($V_{pcas}$) 222 to generate reference current ($I_{ref}$) that is proportional to the difference between second voltage level (HV) 108 and reference voltage ($V_{pcas}$) 222. Second voltage controlled current source 502 further includes a fourth voltage controlled current source 608 and current mirror 600. Fourth voltage controlled current source 608 includes PMOS transistor 603 and PMOS transistor 604. Current mirror 600 includes NMOS transistors 605 and 606 connected together as described in FIG. 6.

Continuing with FIG. 7, control circuit 700 includes a DC load 701 and a MOS amplifier circuit 702. DC load 701 is electrically connected to second voltage level (HV) 108 and to reference voltage ($V_{pcas}$) 222. In one embodiment, MOS amplifier circuit is an NMOS transistor 702. The drain of NMOS transistor 702 is connected to reference voltage ($V_{pcas}$) 222, DC load 701, gate of first PMOS transistor 603, and gate of second PMOS transistor 604. The source of NMOS transistor 702 is connected to electrical ground 413. The gate of NMOS transistor 702 is connected to drain of second PMOS transistor 602 and drain of second NMOS transistor 606. The source of first PMOS transistor 601 is connected to first voltage level (LV) 107. The drain of first PMOS transistor 601 is connected to source of second PMOS transistor 602. Gates of first PMOS transistor 601 and second PMOS transistor 602 are connected to electrical ground 413. The substrates of first PMOS transistor 601, and second PMOS transistor 602, are connected to first voltage level (LV) 107. The source of first PMOS transistor 603 is connected to second voltage level (HV) 108. The drain of first PMOS transistor 603 is connected to source of second PMOS transistor 604. The substrates of first PMOS transistor 603 and second PMOS transistor 604 are connected to second voltage level (HV) 108. The drain of second PMOS transistor 604 is connected to drain and gate of first NMOS transistor 605, and the gate of second NMOS transistor 606. The sources of first NMOS transistor 605 and second NMOS transistor 606 are connected to electrical ground 413.

Continuing with FIG. 7, in operation, whenever the drain voltage of second NMOS transistor 606 decreases, it turns off NMOS transistor 702, and DC load 701 pulls reference voltage ($V_{pcas}$) 222 toward second voltage level (HV) 108. Whenever, the drain voltage of second NMOS transistor 606 becomes high, NMOS transistor 702 turns on and pulls reference voltage ($V_{pcas}$) 222 toward electrical ground 413. Thus, control circuit 700 provides higher accuracy for reference voltage ($V_{pcas}$) 222, especially when reference voltage ($V_{pcas}$) 222 is near electrical ground.

Figure 8:
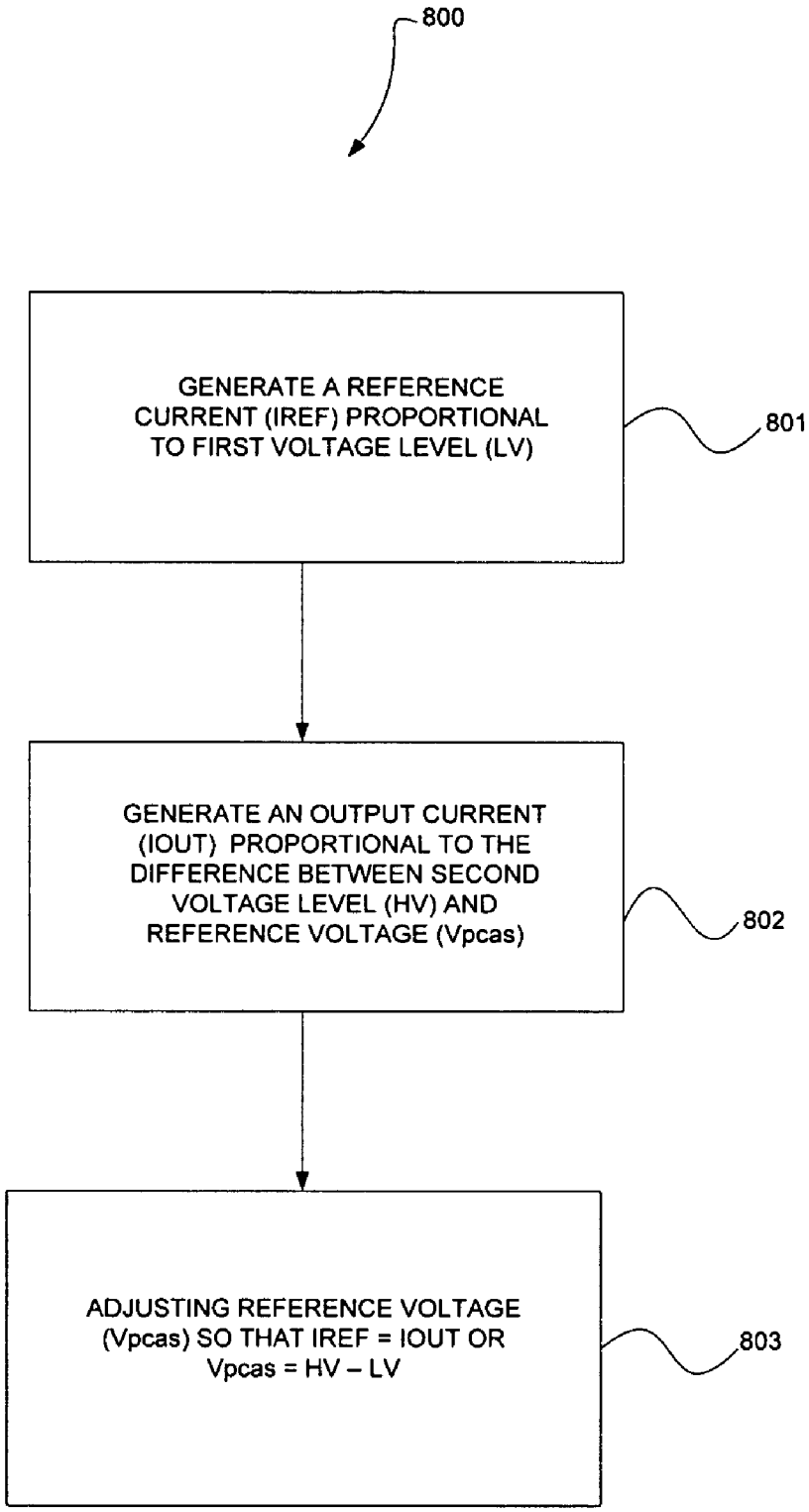
FIG. 8 illustrates a block diagram of a method for generating a reference voltage ($V_{pcas}$) that can automatically track the changes and variations of the first voltage level (LV) and the second voltage level (HV) in accordance with the present invention.

Now referring to FIG. 8, a method 800 for generating a reference voltage ($V_{pcas}$) 222 that can automatically sense a first voltage level and a second voltage level is disclosed. Method 800 includes step of generating a reference current ($I_{ref}$) proportional to first voltage level (LV) 107 using first voltage controlled current source 501, generating an output current ($I_{out}$) using second voltage controlled current source 502, and adjusting reference voltage ($V_{pcas}$) 222 so that output current ($I_{out}$) is approximately equal to reference current ($I_{ref}$), thus reference voltage ($V_{pcas}$) 222 being proportional to the difference between the second voltage level (HV) 108 and first voltage level (LV) 107.

Referring to step 801, reference current ($I_{ref}$) is generated using first voltage controlled current source 501. Referring again to FIG. 6, the reference current ($I_{ref}$) is generated by first voltage controlled current source 501 including third voltage controlled current source 607 and current mirror 600. In the embodiment of FIG. 6, reference current ($I_{ref}$) is proportional to the voltage difference between a first voltage level (LV) 107 and electrical ground 413. In the embodiment shown in FIG. 7, the reference current ($I_{ref}$) is generated by second voltage controlled current source 502 that further includes fourth voltage controlled current source 608 and current mirror 600. In the embodiment of FIG. 7, reference current ($I_{ref}$) is proportional to the difference between second voltage level (HV) 108 and reference voltage ($V_{pcas}$) 222.

Referring to step 802, an output current ($I_{out}$) is generated using second voltage controlled current source 502. Referring again to FIG. 6, output current ($I_{out}$), generated by second voltage controlled current source 502, is proportional to the voltage difference between a second voltage level (HV) and a reference voltage ($V_{pcas}$) 222. In the embodiment of FIG. 7 the output current ($I_{out}$) is generated by second voltage controlled current source 607. In this embodiment, output current is proportional to first voltage level (LV) 107.

Referring to step 803, reference voltage ($V_{pcas}$) 222 is adjusted so that reference current ($I_{ref}$) and the output current ($I_{out}$) are approximately equal to each other. More particularly, reference current ($I_{ref}$) and the output current ($I_{out}$) are summed on one node, which forces the currents to be equal. The voltage on this summing node is used to change the voltage on the reference voltage ($V_{pcas}$) 222. In the embodiment of FIG. 6 the summing node is the reference voltage itself. In the embodiment of FIG. 7 the summing node is the drain of second NMOS transistor 606, which is the input to MOS amplifier circuit 702 which in turn drives the reference voltage. The reference voltage ($V_{pcas}$) 222 so produced is equal to the second voltage level (HV) 108 minus the first voltage level (LV) 107. An over voltage clamping device 610 may be added to limit the maximum reference voltage during power-up and power-down.

The present embodiment of the present invention is thus described. While the present invention has been described in particular embodiments, it should be appreciated that the present invention should not be construed as limited by such embodiments, but rather construed according to the following claims.

What is claimed is:

1. An auto voltage sensing circuit, comprising:

a first voltage controlled current source operable to receive a first voltage level to generate a reference current proportional to said first voltage level; and a second voltage controlled current source, electrically coupled to said first voltage controlled current source, operable to receive a second voltage level and a reference voltage to generate an output current proportional to the difference between said second voltage level and said reference voltage, said reference voltage causing said output current to be approximately equal to said reference current so that said reference voltage is proportional to the difference between said second voltage level and said first voltage level.

2. The auto voltage sensing circuit claim 1 wherein said auto voltage sensing circuit is fabricated so as to generate said reference voltage that is equal to the difference between said second voltage level and said first voltage level.

3. The auto voltage sensing circuit of claim 1 wherein said second voltage level is greater than said first voltage level.

4. The auto voltage sensing circuit of claim 1 wherein said first voltage controlled current source further comprises a third voltage controlled current source and a current mirror, said current mirror allows said first voltage controlled current source to be approximately matched to said second controlled current source.

5. The auto voltage sensing circuit of claim 1 further comprising an overvoltage clamping device electrically coupled to said reference voltage to prevent said reference voltage from exceeding a predetermined maximum voltage level.

6. The auto voltage sensing circuit of claim 4 wherein said current mirror comprises a first NMOS transistor and a second NMOS transistor, the gate of said first NMOS transistor electrically connected to the gate of said second NMOS transistor and to the drain of said first NMOS transistor, the drain of said first NMOS transistor electrically coupled to said third voltage controlled current source, the drain of said second NMOS electrically coupled to said second voltage controlled current source, the sources of first NMOS transistor and second NMOS transistor electrically connected to an electrical ground.

7. The auto voltage sensing circuit of claim 4 wherein said third voltage controlled current source further comprises a first PMOS transistor electrically coupled in series to a second PMOS transistor, the drain of said first PMOS transistor electrically coupled to the source of said second PMOS transistor, the gate of said first PMOS transistor electrically connected to the gate of said second PMOS transistor and to an electrical ground, the source of said first PMOS transistor electrically connected to said first voltage level, the drain of second PMOS transistor electrically connected to said current mirror, the substrates of said first PMOS transistor and said second PMOS transistor electrically connected together and to said first voltage level.

8. The auto voltage sensing circuit of claim 1 wherein said second voltage controlled current source further comprises a first PMOS transistor electrically coupled in series to a second PMOS transistor, the drain of said first PMOS transistor electrically coupled to the source of said second PMOS transistor, the gate of said first PMOS transistor electrically connected to the gate of said second PMOS transistor and to said reference voltage, the source of said first PMOS transistor electrically connected to said second voltage level, the drain of second PMOS transistor electrically connected to said current mirror, the substrates of said first PMOS transistor and said second PMOS transistor electrically connected together and to said second voltage level.

9. An auto voltage sensing circuit, comprising:

a first voltage controlled current source operable to receive a first voltage level to generate a reference current proportional to the difference between a second voltage level and a reference voltage level;

a second voltage controlled current source, electrically coupled to said first voltage controlled current source, operable to receive said second voltage level to generate an output current proportional to said second voltage level; and a control circuit, electrically coupled to said first voltage controlled current source, operable to receive said reference current and said output current to cause said output current to be approximately equal to said reference current so that said reference voltage is proportional to the difference between said second voltage level and said first voltage level.

10. The auto voltage sensing circuit of claim 9 wherein said first voltage controlled current source further comprises a current mirror, said current mirror causes said first voltage controlled current source to be approximately matched to said second controlled current source.

11. The auto voltage sensing circuit of claim 10 further comprising an overvoltage clamping device electrically coupled to said reference voltage to prevent said reference voltage from exceeding a predetermined maximum voltage level.

12. The auto voltage sensing circuit of claim 11 wherein said control circuit further comprises a pull-up direct current (DC) load and a MOS amplifier circuit, said pull-up DC load electrically coupled to said second voltage level and said reference voltage, said MOS amplifier circuit electrically coupled to said current mirror and to said reference voltage.

13. The auto voltage sensing circuit of claim 11 wherein said amplifier circuit is a NMOS transistor, the drain of said NMOS transistor electrically coupled to said reference voltage, the gate of said NMOS transistor electrically coupled to said current mirror and the source of said NMOS transistor electrically coupled to an electrical ground.

14. An Integrated Circuit (IC) device in communication with a second IC device operating at a second voltage level, comprising:

a first system generating an output signal at a first voltage level; and a high speed Metal Oxides Field Effect Transistor (MOSFET) output driver coupled to receive an output signal from said first system, said high speed MOSFET output driver further comprising an auto voltage sensing circuit operable to generate a reference voltage level proportional to the difference between said first voltage level and said second voltage level, and a high voltage cascode output buffer.

15. An IC device of claim 14 wherein said auto voltage sensing circuit further comprises:

a first voltage controlled current source operable to receive said first voltage level to generate a reference current proportional to said first voltage level; and a second voltage controlled current source, electrically coupled to said first voltage controlled current source, operable to receive said second voltage level to generate an output current proportional to the difference between said second voltage level and said reference voltage, said reference voltage causing said output current to be approximately equal to said reference current.

16. An IC device of claim 14 wherein said auto voltage sensing circuit further comprises:

a first voltage controlled current source operable to receive a first voltage level to generate a reference current proportional to the difference between a second voltage level and said reference voltage level;

a second voltage controlled current source, electrically coupled to said first voltage controlled current source, operable to receive said second voltage level to generate an output current proportional to said second voltage level; and a control circuit, electrically coupled to said first voltage controlled current source, operable to receive said reference current and said output current to cause said output current to be approximately equal to said reference current so that said reference voltage is proportional to the difference between said second voltage level and said first voltage level.

17. The MOSFET device of claim 16 wherein said control circuit further comprises a pull-up direct current (DC) load and an amplifier circuit, said pull-up DC load electrically coupled to said second voltage level, said amplifier circuit electrically coupled to said current mirror and said reference voltage.

18. The MOSFET device of claim 14 wherein said high voltage cascode output buffer further comprises:

a first PMOS transistor, a second PMOS transistor, a first NMOS transistor, and a second NMOS transistor electrically coupled together in cascode, the source of said first PMOS transistor electrically coupled to said second voltage level, the drain of said first PMOS transistor electrically coupled to the source of said second PMOS transistor, the gate of said first PMOS transistor is electrically connected to said high speed MOSFET output driver, the drain of said second PMOS transistor electrically connected to the drain of said first NMOS transistor to form an output terminal of said high voltage cascode output buffer, the gate of said second PMOS transistor electrically coupled to said auto voltage sensing circuit, the gate of said first NMOS transistor electrically connected to said first voltage level, the source of said first NMOS transistor electrically connected to the drain of said second NMOS transistor, the gate of said second NMOS transistor electrically connected to said output signal of said first system, and the source of said second NMOS transistor electrically connected to an electrical ground.

19. The MOSFET device of claim 14 further comprising an analog voltage buffer coupled to receive said reference voltage from said auto voltage sensing circuit to drive a plurality of said high voltage output buffers.

20. A method of automatically sensing a first voltage level and a second voltage level, comprising:

generating a reference current that is proportional to said first voltage level using a first voltage controlled current source;

generating an output current that is proportional to the difference between said second voltage level and said first voltage level using a second voltage controlled current source; and adjusting said reference voltage so that said reference voltage is proportional to the difference between said second voltage level and said first voltage level.

21. The method of claim 20 further comprising a step of clamping said reference voltage to a predetermined maximum voltage level.

22. The method of claim 20 further comprising the steps of maintaining said reference voltage at a constant voltage level.

23. The method of claim 22 wherein said maintaining said reference voltage step further comprises:

pulling said reference voltage to said constant voltage level when said reference voltage is lower than said constant voltage level; and sinking said reference voltage to said constant voltage level when said reference voltage is higher than said constant voltage level.

24. An auto voltage sensing circuit, comprising:

means for generating a reference current that is proportional to said first voltage level using a first voltage controlled current source;

means for generating an output current, electrically coupled to said means for generating said reference current, said output current being proportional to the difference between said second voltage level and said first voltage level using a second voltage controlled current source; and means for adjusting said reference voltage, electrically coupled between said means for generating said reference current and said means for generating said output current, so that said reference voltage is proportional to the difference between said second voltage level and said first voltage level.

* * * * *